US005972144A

United States Patent [19]

Hsu

[11] Patent Number: 5,972,144

[45] Date of Patent: Oct. 26, 1999

[54] METHOD FOR MANUFACTURING GOLF CLUB PUTTER HEADS

[76] Inventor: Tsai-Fu Hsu, No. 386, Liao Ning 1st St., San Min District, Kaohsiung, Taiwan

[21] Appl. No.: 09/038,009

[22] Filed: Mar. 11, 1998

[51] Int. Cl.[6] ..... A63B 53/04

[52] U.S. Cl. ..... 156/154; 156/242; 156/293; 473/340; 473/342

[58] Field of Search ..... 473/342, 329, 473/330, 340; 428/542.4; 156/293, 242, 154

[56] References Cited

U.S. PATENT DOCUMENTS 3,863,932 2/1975 Lezatte ..... 273/169
4,679,792 7/1987 Straza et al. ..... 273/78
5,460,377 10/1995 Schmidt et al. ..... 273/173
5,575,472 11/1996 Magerman et al. ..... 29/530

*Primary Examiner*—Jeff H. Aftergut
*Assistant Examiner*—Gladys Piazza
*Attorney, Agent, or Firm*—Rosenberg, Klein & Bilker

[57] ABSTRACT

A method for manufacturing golf club putter heads includes four steps, 1. forming a recess in a striking face of a club putter head, 2. adhering a decorative plate with a name or pattern in the recess, 3. pouring epoxy resin solution in said recess and letting it dry up to form an insert block, 4. grinding the upper surface of the decorating plate and the insert block flush with the striking face of the putter head. Then the name or pattern may not wear or disappear even if hit by golf balls for a long period of time.

6 Claims, 4 Drawing Sheets

METHOD FOR MANUFACTURING GOLF CLUB PUTTER HEADS

BACKGROUND OF THE INVENTION

This invention relates to a method for manufacturing golf club putter head, particularly to one having a striking face provided with characters or pattern not wearing or disappearing even by hitting golf balls for a long period of time.

Conventional golf club putter heads mostly have a trademark with a name or pattern of a maker printed on a striking face for advertisements. Such a golf club putter head 10 shown in FIG. 5 has a name or pattern 20 printed on a metal striking face 101 of the putter head 10. Another conventional golf club putter head 30 shown in FIG. 6 has a recess 302 formed in a striking face 301 with a hitting plate 303 of light soft and elastic material such rubber, plastic or carbon fiber fitted fixedly in the recess 302. Then a golf ball may be hit to fly straight, not biased. In addition, the name or pattern is printed on the surface of the striking face 301. However, these two kinds of conventional golf club putter heads have the following defects. 1. The name or pattern 20 is printed on the surface of the striking face 101 or the hitting plate 303, forming concave and convex sections to cause inaccurate flying of a golf ball when hit. 2. The name or pattern 20 may wear and disappear by hitting golf balls for a long period of time, losing original beautiful appearance or advertising effect.

SUMMARY OF THE INVENTION

This invention has a purpose of offering a method for manufacturing golf club putter heads including four steps of processes listed below. 1. Forming a recess in a striking face of a golf club putter head. 2. Adhering a decorative plate provided with relief characters or patter in the recess of the striking face of the golf club putter head. 3. Forming an insert block by pouring a material such as epoxy resin in the recess and let it dry up. 4. Grinding upper surfaces of the insert block and the decorative plate flush with the striking face.

Thus, the name or pattern may not wear down or disappear by frequent hitting action, or have any concave or convex sections to give any bad impact on hitting golf balls.

BRIEF DESCRIPTION OF DRAWINGS

This invention will be better understood by referring to the accompanying drawings, wherein.

DETAILED DESCRIPTION OF THE PREFERRED EMBODIMENT

Figure 2:
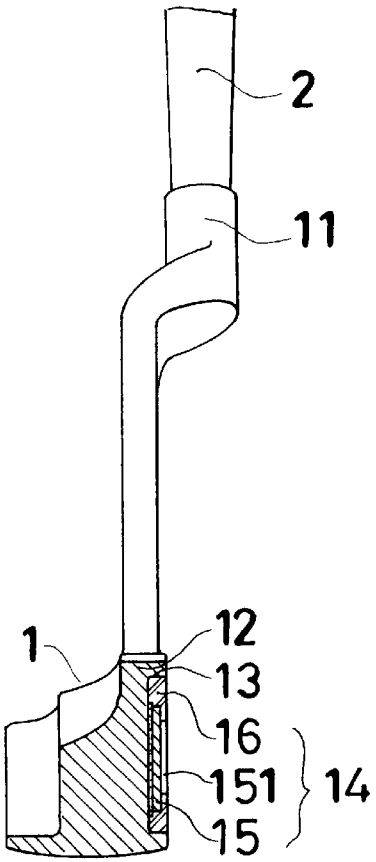
FIG. 2 is a cross-sectional view of the golf club putter head made according to the method for manufacturing golf club putter heads of the present invention.
Figure 1:
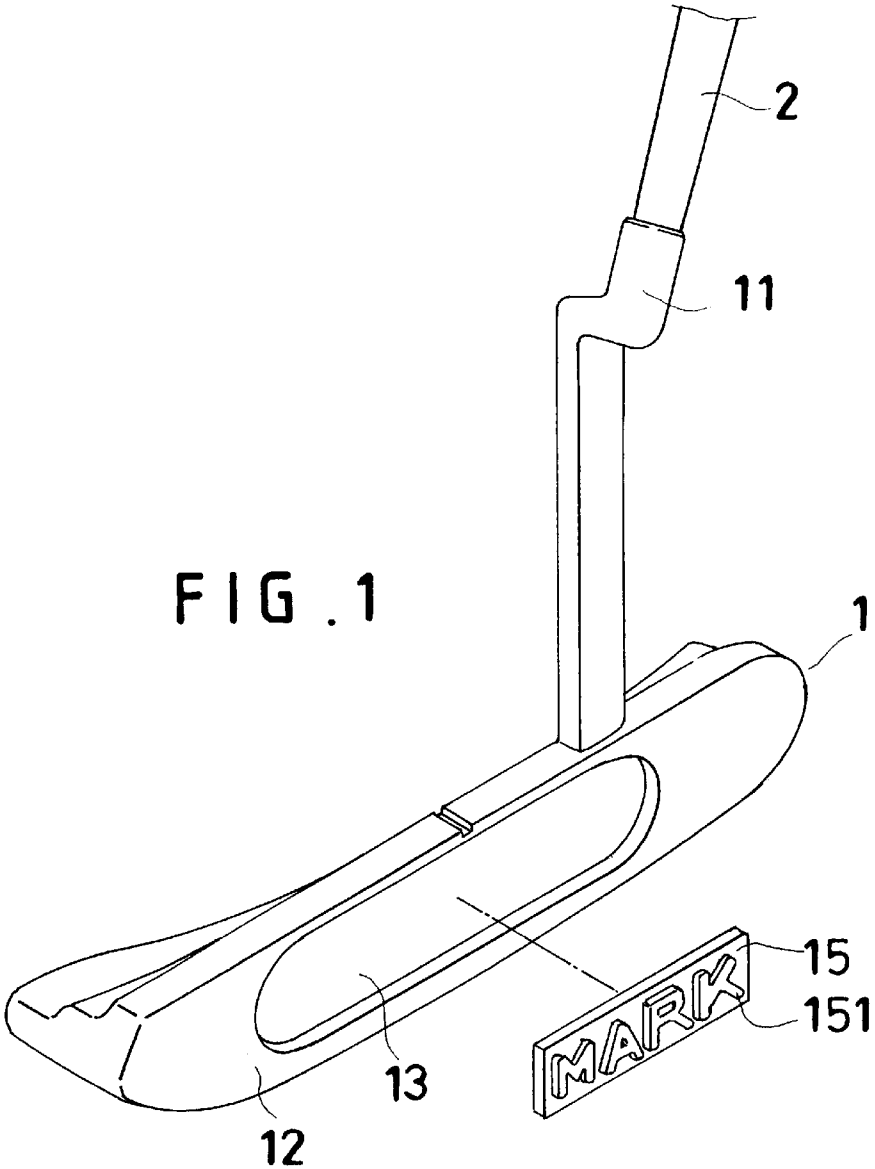
FIG. 1 is an exploded perspective view of a golf club putter head made according to a method for manufacturing gold club putter heads of the present invention.
Figure 3:
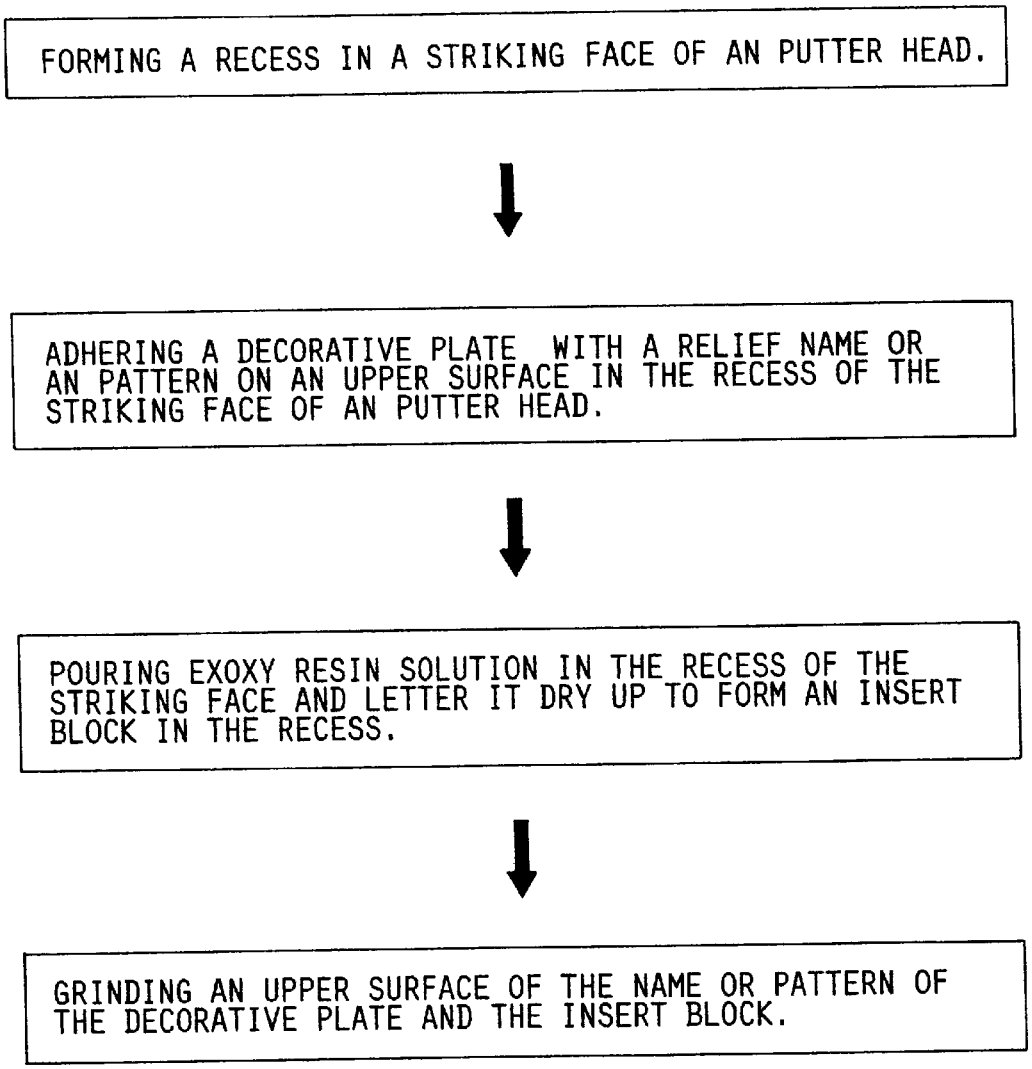
FIG. 3 is a block diagram of the method for manufacturing golf club putter heads of the present invention.

A preferred embodiment of a method for manufacturing gold club putter heads in the present invention, as shown in FIGS. 1, 2 and 3, includes four steps of manufacturing processes as described below. 1. First step. Forming a recess 13 in a striking face 12 of a putter head 1., which also has a hollow cylinder 11 extending upward from the head 1 for fitting fixedly a golf club 2 therein. 2. Second step. Adhering fixedly a decorative plate 15 with a name or pattern in the recess 13. 3. Third step. Injecting epoxy resin solution in the recess 13 and letting it dry up into an insert block 16 in the recess 13. 4. Fourth step. Grinding upper surfaces of the insert block 16 flush with the striking face 12.

The decorative plate 15 adhered in the recess 13 has a relief pattern, or a relief name 151, which are visible after fixed in the insert block 16 formed in the recess 13.

Figure 4:
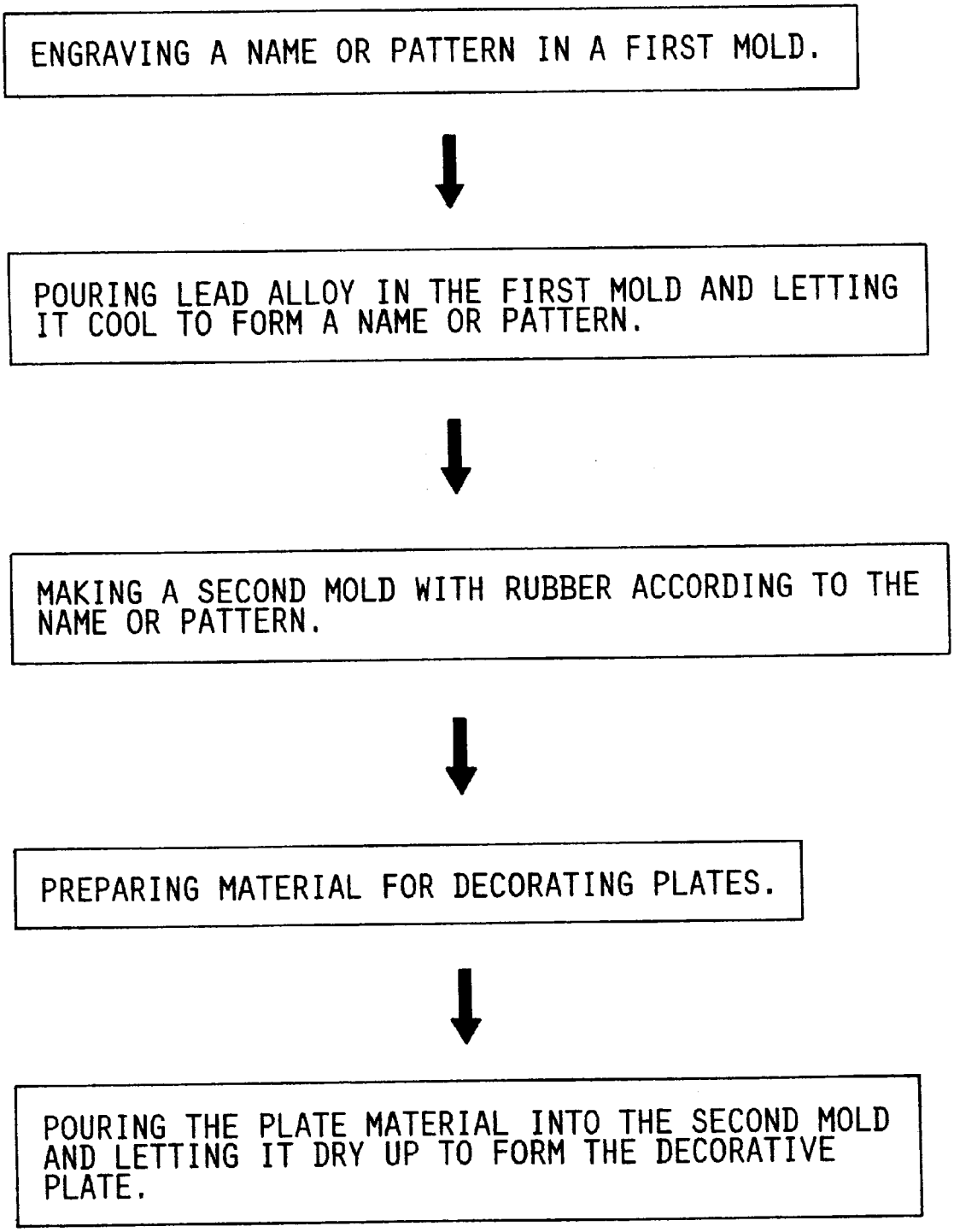
FIG. 4 is a block diagram of a method for manufacturing decorative plates of a golf club putter head of the present invention.
Figure 6:
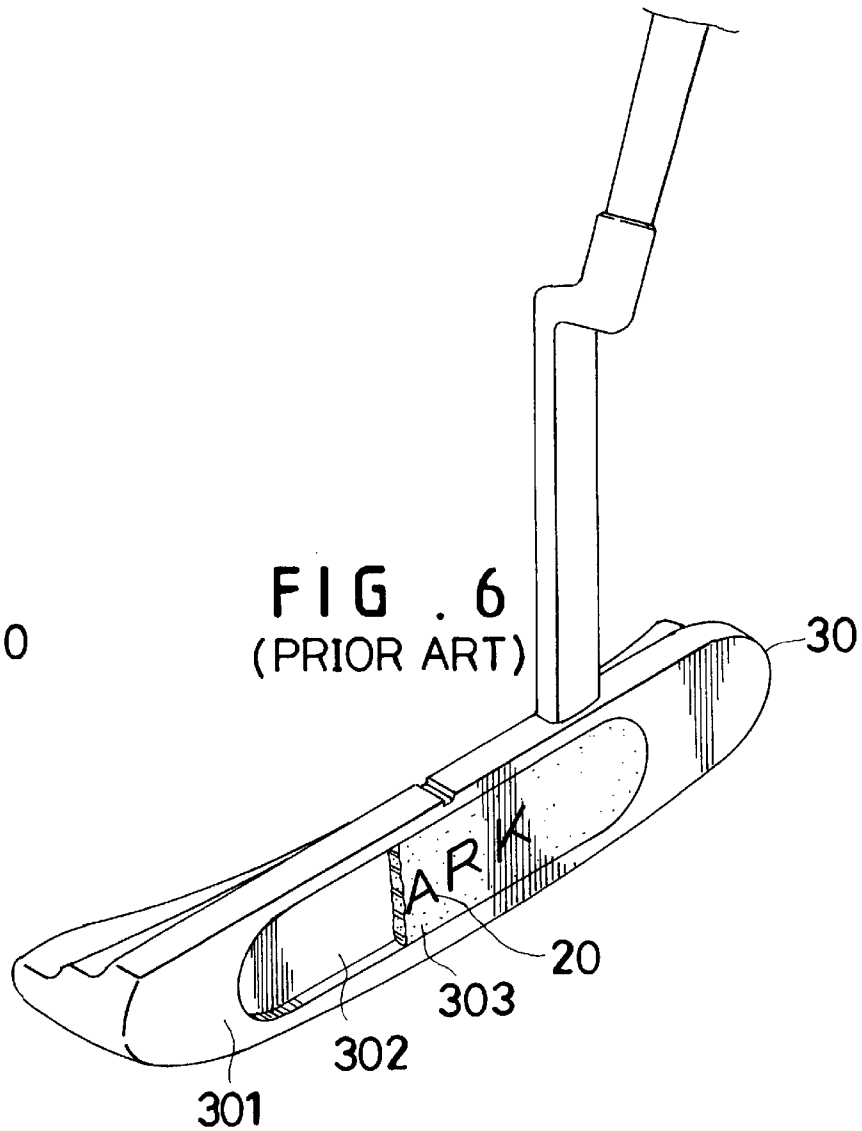
FIG. 6 (PRIOR ART)
FIG. 6 is a perspective view of another conventional golf club putter head.
Figure 5:
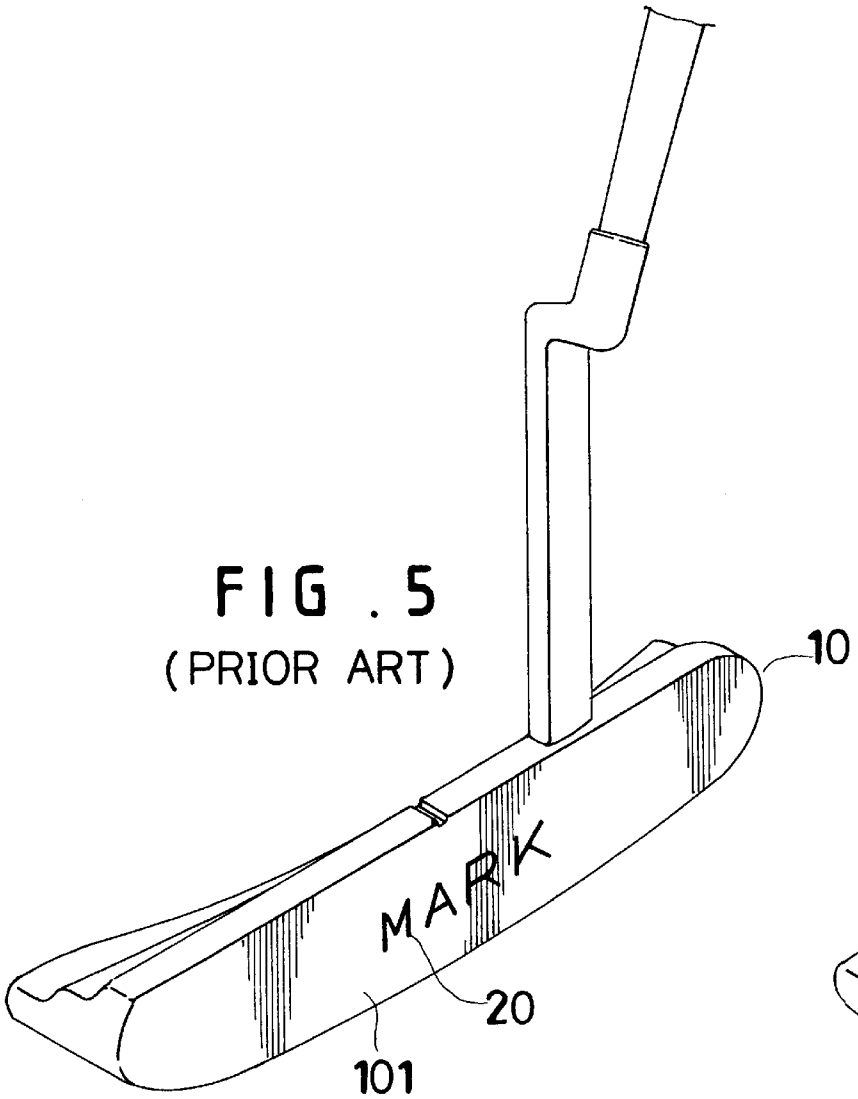
FIG. 5 (PRIOR ART)
FIG. 5 is a perspective view of a conventional golf club putter head.

A method for manufacturing the decorative plate 15 is shown in FIG. 4, including five processes described below. 1. First step. Engraving a name or pattern wanted in a first mold. 2. Second step. Pouring lead alloy in the first mold to make the name or pattern. 3. Third step. Making a second mold of rubber with the lead alloy of the name or pattern. 4. Fourth step. Preparing material for decorative plates. 5. Fifth step. Making the decorative plate by pouring the plate material in the rubber mold and letting it dry up.

The depth of the name or pattern engraved in the first mold may preferably be 1, 4 mm, and the lead alloy is poured in the first mold and dried out to make the name or pattern, which is then arranged in a row for making a second rubber mold. Then material for decorative plates is prepared by mixing and stirring epoxy resin solution with an additive and a hardening chemical together, added with a pigment and then removing of bubbles with a vacuum debubbling machine for one minute. Lastly, the plate material is poured in the second rubber mold and then dried for 24 hours, forming a decorative plate 15 with a relief name or pattern.

As the surface of the striking face 12 is flush with the name or pattern 151 of the decorative plate 15 and the insert block 16, a golf ball may be hit and fly straight, not biasing because of the light soft elastic property of the material they are made of. In addition, the name or pattern 151 is made relief on the upper surface of the decorative plate 15, which is then kept fixed in the insert block 16, the name or pattern 151 is securely kept in position, unable to wear or disappear. Moreover, the color of the decorative plate is made different from the insert block 16 and the striking face 12, making it particularly attractive.

As may be understood from the aforesaid description, this invention has the following advantages. 1. The name or pattern is fixedly kept in place, with the decorative plate 15 fixed surrounded by the insert block 16. 2. The name or pattern 151 is flush with the striking face, not causing any impact on hitting action of a golf ball as does a conventional putter head with a name or pattern printed or embossed on the striking face. 3. The name or pattern 151 is flush with the striking face, not wearing down or disappearing even for a long period of hitting golf balls as does a conventional putter head with a name or pattern printed or embossed on the striking face. 4. The color of the name or pattern of the decorative plate 15 can be made different from those of the insert block 16 and the striking face, making it look more attractive.

While the preferred embodiment of the invention has been described above, it will be recognized and understood that various modifications may be made therein and the appended claims are intended to cover all such modifications which may fall within the spirit and scope of the invention.

What is claimed is:

1. A method for manufacturing a golf club putter head comprising (a) forming a recess in a striking face of a putter head having a hollow cylinder extending upward for a golf club to be fixed therein, (b) adhering fixedly in said recess a decorative plate provided with a relief name or pattern on its surface, (c) pouring a first material in said recess and letting it dry up to become an insert block so as to fix said decorative plate securely in said recess with said name or pattern visible, (d) grinding an upper surface of said insert block and said decorative plate with said name or pattern flush with said striking face of said putter head; wherein said decorative plate is formed by the steps comprising:

(e) engraving a wanted name or pattern in a first mold, (f) pouring a second material in said first mold and letting it dry to become said name or pattern, (g) arranging said name or pattern in a row and then making a second mold with a third material according to said name or pattern, (h) preparing material for said decorative plate by adding and stirring an additive and a hardening chemical into a fourth material and then adding a pigment into said fourth material and (i) pouring said fourth material in said second mold and then letting it dry up to form said decorative plate with said relief name or pattern.

2. The method for manufacturing golf club putter head as claimed in claim 1, wherein said first material is epoxy resin.

3. The method of manufacturing golf club putter head as claimed in claim 1, wherein said second material is a lead alloy.

4. The method of manufacturing golf club putter head as claimed in claim 1, wherein said third material is rubber.

5. The method of manufacturing golf club putter head as claimed in claim 1, wherein said fourth material added with said additive, said hardening chemical and stirred and then added with the pigment, wherein bubbles are removed therefrom with a vacuum debubbling machine.

6. The method of manufacturing golf club putter head as claimed in claim 1, wherein said fourth material is epoxy resin.

* * * * *